252-99 AJ 166 EX
4/11/78 OR 4,083,795

United States Patent [19]

Joubert

[11] 4,083,795

[45] Apr. 11, 1978

[54] SOLID, NON-CORROSIVE DETERGENT COMPOSITIONS

[75] Inventor: Daniel Joubert, Trevoux, France

[73] Assignee: Rhone-Poulenc Industries, Paris, France

[21] Appl. No.: 648,130

[22] Filed: Jan. 12, 1976

[30] Foreign Application Priority Data

Jan. 24, 1975 France ..... 75 02234
Jul. 31, 1975 France ..... 7523924

[51] Int. Cl.[2] ..... C11D 7/56
[52] U.S. Cl. ..... 252/99; 252/94; 252/146
[58] Field of Search ..... 252/146, 99, 94

[56] References Cited

U.S. PATENT DOCUMENTS 3,755,180 8/1973 Austin ..... 252/99

FOREIGN PATENT DOCUMENTS 1,333,810 10/1973 United Kingdom.

*Primary Examiner*—Mayer Weinblatt
*Attorney, Agent, or Firm*—McDougall, Hersh & Scott

[57] ABSTRACT

A non-corrosive detergent cleaning composition adapted primarily for cleaning dishes and textiles formulated to contain a mixture of detergent agents, oxidizing or disinfecting agents, non-ionic or a mixture of non-ionic and anionic agents, and which may include filling agents, the improvement wherein the composition is formulated to contain a sodium silico-aluminate which inhibits coloring, corrosion and degradation of chlorine derivatives, with or without a silico-aluminate to inhibit tarnishing of aluminum.

8 Claims, No Drawings

SOLID, NON-CORROSIVE DETERGENT COMPOSITIONS

The invention relates to new solid, non-corrosive detergent compositions in powder form, for cleaning materials such as glass, china, earthenware, ceramics, etc.

Applicant's French Pat. No. 2,105,475 claims new detergent compositions comprising a mixture of detergent agents, oxidizing or disinfecting agents, non-ionic agents or a mixture of non-ionic and anionic agents and possibly filling agents; the compositions are characterized in that they also contain a corrosion-inhibiting and color-inhibiting additive belonging to the group of sodium silico-aluminates of the general formula $x\ Na_2O$, $y\ Al_2O_3$, $z\ SiO_2$, $w\ H_2O$ wherein, if $y$ equals 1, $x$ is advantageously from 0 to 2, $z$ from 4 to 16 and $w$ from 0.3 to 4.

In this formula, the letter $w$ expresses the OH radicals bonded to the silica and alumina in the form of water. This water is measured by the difference between the product's loss of weight on ignition (parte au feu) at 900° C and its moisture content, determined by drying at 140° C. A silico-aluminous additive of this type further contains a certain amount of absorbed water, which may vary from 1.5 to 50% by weight of the final product used (50% of water and 50% of dry product being the upper limit).

An additive of this type has given excellent results as a corrosion and color inhibitor.

However, it is known that chlorine derivatives are now being used increasingly in detergent compositions, since they have the dual advantage of having a certain bactericidal power and of acting as deodorizing agents.

Unfortunately the chlorine derivatives used are unstable in storage.

Various solutions to this problem have been proposed. Thus U.S. Pat. No. 3,166,513 states that the rate of chlorine loss is substantially reduced when the active chlorine derivative is sodium dichloro-isocyanurate.

It has also been proposed to include chemical stabilizers (U.S. Pat. No. 3,352,785) or a white paraffin oil (U.S. Pat. No. 3,350,092).

When all these solutions proved inadequate, dihydrated alkaline sodium dichloro-isocyanurate was proposed in French Pat. No 2,207,982 as a source of active chlorine in dishwashing compositions.

Although such a product proved to be more stable than the others hitherto used, a loss of chlorine is still observed when detergent compositions are stored for a long time.

It has also been observed that, although the sodium silico-aluminates claimed give excellent results in most cases and particularly as far as glass and decorative finishes (decors) are concerned, they still leave two problems to be dealt with, viz, degradation and blackening of utensils made of aluminum and/or aluminum alloys.

It has already been proposed to use sodium silicates to inhibit corrosion in light alloys.

If they are to produce satisfactory results, however, the silicates must be used in relatively strong doses, and the more alkaline the medium to inhibit is, the stronger the doses have to be.

This is the case with mechanical dish-washing, where alkaline pH levels are absolutely essential if a satisfactory cleaning action is to be obtained.

When it is in the liquid state, however, the addition of such doses of silicate poses problems due to the appearance of a caking effect, which results from the vitreous character of the silicate and the degradation of the chlorine salt.

One would have thought that a simple solution would have been to use powdered silicates.

Unfortunately such silicates dissolve slowly, which means that they are not effectively present during a good part of the wash and consequently that they cannot act as corrosion inhibitors.

It has now been found that these drawbacks can be avoided by using a sodium silico-aluminate.

In particular it has been found, unexpectedly, that the stability of chlorine derivatives in a detergent composition can be increased considerably, and that this stability can be maintained in the presence of perfumes, which generally make chlorine products still more unstable.

The chlorine derivatives, according to the invention, comprise any products which are generally commercially available, such as sodium isocyanurates; more particularly, they comprise sodium dichloro-isocyanurate and preferably dihydrated sodium dichloro-isocyanurate.

Finally, the perfume comprises synthetic organic products or natural extracts (alcohols, esters, ketones, aldehydes, ether-oxides, terpenes, etc.) recalling the odor of lemon, orange or mint.

During the preparation of a detergent composition according to the invention, it has further been found advantageous to add the chlorine compound after the inclusion of the sodium silico-aluminate and after the addition of any perfume which the detergent composition may contain.

It has also been found that a sodium silicate can be introduced in liquid and thus soluble form, so as to avoid the above-mentioned drawbacks with regard to the appearance of the detergent and its stability.

In accordance with the invention, a premix of a sodium silicate, initially in liquid form, which is absorbed by a sodium silico-aluminate of the formula $x\ Na_2O$, $y\ Al_2O_3$, $z\ SiO_3$, $w\ H_2O$ is included in the detergent; the sodium silicate has a molar ratio $SiO_2/Na_2O$ of from 2.5 to 4/1 and advantageously forms 1 to 5% of the weight of the detergent composition.

The sodium silico-aluminates according to the invention are of the above general formula $x\ Na_2O$, $y\ Al_2O_3$, $z\ SiO_2$, $w\ H_2O$ wherein, if $y$ equals 1, $x$ is advantageously from 0 to 2, $z$ from 4 to 16 and preferably from 6 to 15 and $w$ from 0.3 to 4 and more particularly from 0.5 to 2.5.

Generally speaking such silico-aluminates are in the form of a non-abrasive, white powder which is very fine and dusty, however much water is absorbed. The agglomerates forming it have an average dimension of from 2 to 10 microns, while the very fine ultimate particles have dimension ranging from 50 to 900 Angstroms, measured by conventional methods with an electron microscope.

The silico-aluminates have a BET (BRUNAUER, EMMET and TELLER) specific surface area, measured by adsorption of nitrogen, of from 50 to 600 $m^2$/gram and advantageously from 70 to 250 $m^2$/gram.

The sodium silico-aluminate, according to the invention, preferably comprises an amorphous synthetic silico-aluminate and has a porosity of from 50 to 200

$cm^3$/100 grams, measured on a mercury porosimeter for cavities in the range from 400 A to 2.5 $\mu$.

In practice the proportions of each of the constituents of a detergent composition according to the invention advantageously fall within the following limits (per 100 parts by weight of total composition):

| | |
|---|---|
| sodium metasilicate | 10 to 60 parts |
| sodium tripolyphosphate | 30 to 75 parts |
| chlorine derivative | 3 to 10 parts |
| non-ionic surfactants or mixture of non-ionic and anionic surfactants | 2 to 20 parts |
| fillers | 0 to 10 parts |
| perfume | 0 to 0.5 part |
| sodium alumino-silicate | 0.5 to 4 parts |

The surfactants used may comprise non-ionic agents, as is the case of condensates of ethylene oxide on propylene-glycol or of ethylene oxide on alkyl phenols, or a mixture of above-mentioned non-ionic agents with anionic agents such as those belonging to the families of sodium alkylaryl-sulphonates, sodium alkylsulphates, sodium alkylsulphonates, etc.

The fillers are such as sodium carbonate or sodium sulphate.

In another preferred embodiment of the invention such a detergent composition contains, by weight:

20 to 70% of sodium metasilicate
20 to 50% of sodium tripolyphosphate
0 to 40% of sodium carbonate
0 to 20% of sodium sulphate
0 to 10% of sodium borate
1 to 4% of a sodium silico-aluminate
1 to 4% of a liquid sodium silicate; 50% having a molar ratio $SiO_2/Na_2O$ of from 2.5 to 4/1
2.5 to 3% of a non-ionic surfactant
0.5 to 3% of a compound adapted to liberate chlorine.

However, the invention will be more easily understood from the examples which follow; these are given to illustrate the invention and do not impose any restrictions on it.

EXAMPLE 1

To a powdered mixture including sodium metasilicate, sodium tripolyphosphate and a surfactant there is added, or not, a silico-aluminate according to the invention, then a perfume and finally a chlorine derivative.

The percentage by weight of initial chlorine in the detergent formulation employed and the residual chlorine content after storing for six months are determined each time. The chlorine is measured by iodometric methods.

Finally, the percentage of residual chlorine relative to the initial chlorine is given in the comparative table which follows:

| TESTS | 1 | 2 | 3 | 4 | 5 | 6 | 7 | 8 | 9 |
|---|---|---|---|---|---|---|---|---|---|
| Sodium tripolyphosphate | 45 | 45 | 44.8 | 43 | 43 | 42.8 | 42.8 | 42.8 | 42.8 |
| Surfactant | 2 | 2 | 2 | 2 | 2 | 2 | 2 | 2 | 2 |
| Sodium metasilicate | 50 | 50 | 50 | 50 | 50 | 50 | 50 | 50 | 50 |
| Sodium silico-aluminate | | | | | 2 | 2 | 2 | 2 | 2 |
| Perfume | | | 0.2 | | | 0.2 | 0.2 | 0.2 | 0.2 |
| Chlorine derivative 1 | 3 | | 3 | 3 | | 3 | | 3 | |
| Chlorine derivative 2 | | 3 | | | 3 | | 3 | | 3 |
| Initial chlorine % of total composition | 1.89 | 1.68 | 1.89 | 1.89 | 1.68 | 1.89 | 1.68 | 1.89 | 1.68 |
| Residual chlorine % after 6 months | 0.98 | 0.93 | 0.81 | 1.55 | 1.66 | 1.45 | 1.29 | 1.31 | 1.32 |
| Residual chlorine % of initial chlorine | 49.2 | 55.2 | 42.8 | 82.0 | 98.7 | 76.8 | 76.8 | 69.3 | 78.0 |

In the above comparative table the proportions of the various constituents are given in parts by weight relative to the total composition.

The surfactant used is an ethoxylated linear alcohol marketed under the name of PLURAFAC RA 43.

The sodium silico-aluminate is a synthetic, amorphous silico-aluminate of the formula 2 $Na_2O$ 6.5 $SiO_2$ $Al_2O_3$ 2 $H_2O$ with a BET surface area of 100 $m^2$/gram. The dimension of the primary aggregates is 1000 A, the size of the ultimate particles 200 A and the porosity, measured on a mercury porosimeter, 100 $cm^3$ per 100 grams.

The perfume is a synthetic aldehyde perfume similar to lemon.

Chlorine derivative 1 is a sodium dichloro-isocyanurate marketed under the name of CDB 63.

Chlorine derivative 2 is a hydrated sodium dichloro-isocyanurate with two molecules of water, marketed under the name of CDB "Clearon."

As will be seen from the summarizing table (see tests 1, 2 and 3), in the absence of a sodium silico-aluminate, a large amount of chlorine is lost and the presence of a perfume (test 3) leads to an additional, fairly substantial loss of chlorine.

The presence of silico-aluminate, according to the invention, (tests 4 and 5) brings a remarkable increase in the stability of the chlorine compound, and this stability is largely maintaned despite the presence of a perfume (tests 6, 7, 8, 9).

The above tests show clearly that the presence of a sodium silico-aluminate, according to the invention, brings an unexpected and very genuine increase in the stability of chlorine compounds in a detergent composition.

EXAMPLE 2

The formulations summarized in the following table are expressed as percentages by weight.

| TESTS | 1 | 2 | 3 | 4 | 5 | 6 | 7 |
|---|---|---|---|---|---|---|---|
| Sodium metasilicate | 60 | 60 | 60 | 60 | 60 | 30 | 70 |
| Sodium tripolyphosphate | 35 | 33 | 34 | 33 | 31 | 61 | 21 |
| Non-ionic surfactant comprising an ethoxy- | | | | | | | |

-continued

| TESTS | 1 | 2 | 3 | 4 | 5 | 6 | 7 |
|---|---|---|---|---|---|---|---|
| lated linear alcohol marketed as PLURAFAC RA 43 | 2 | 2 | 2 | 2 | 2 | 2 | 2 |
| Sodium silico-aluminate of the formula 6 . 5 $SiO_2$, $Al_2O_3$, 2 $Na_2O$ | — | — | — | 2 | 2 | 2 | 2 |
| Liquid silicate $SiO_2/Na_2O$ = 3.5/1 50% | — | 2 | — | — | 2 | 2 | 2 |
| Powdered silicate with same $SiO_2/Na_2O$ ratio | — | — | 1 | — | — | — | — |
| Chlorine salt(sodium dichloro-isocyanurate marketed as CDB Clearon) | 3 | 3 | 3 | 3 | 3 | 3 | 3 |

The behavior of these compositions is observed with regard to the following:

their appearance and reaction to storage the stability of the chlorine salt in time their action on aluminum utensils.

Appearance and reaction to storage are tested as follows:

assessment of caking (prise en masse).

The product to be tested is placed in a cylinder. This is associated with a piston adapted to exert a given known pressure, set to a value of 0.8 kg/cm$^2$.

The whole arrangement is then left for 7 days in an enclosure which is kept at a relative humidity of 90%, then for 1 day in a stove with a constant temperature set to 40° C.

The sample is then placed in an apparatus for measuring the pressure required to break it up.

assessment of flow properties.

50 grams of the product to be tested is placed in a funnel sealed at the base. The bottom of the funnel is 180 mm away from a receiving level. The product is left in the funnel for 1 minute, then freed. It flows out, forming a conical pile. The diameter $d$ at the base of the cone and the height $h$ of the cone are measured.

The angle $a$ is then determined, defined by the equation $tg\ a = 2h/d$. The smaller the angle $a$, the more free-flowing the product is.

assessment of flow from a silo.

This comprises measuring the speed at which the product passes through a silo with a calibrated orifice which undergoes slight vibrations. For this purpose $x$ grams of product is placed in the silo and flow from it is obstructed. At a given moment, the opening in the silo is freed and the vibrator started. The time T for the product to pass through is then noted (expressed in seconds).

These tests are carried out on compositions 2 and 5. The results obtained are summarized in the table below.

| Tests | Pressure Required To Break Blocks kg/cm$^2$ | ANGLE a initially | ANGLE a After 8 days storage in sealed flask | Time For 50 g To Flow Out |
|---|---|---|---|---|
| 2 | 0.8 | 41.5 | 47 | 35 |
| 5 | 0.6 | 37 | 39 | 29 |

These results show the compositions according to the invention to have a novel effect in respect of appearance and reaction to storage.

The percentage of residual chlorine is also calculated, measured by iodometric methods.

| TESTS | 1 | 2 | 3 | 4 | 5 | 6 | 7 |
|---|---|---|---|---|---|---|---|
| Residual chlorine % by weight | 70 | 45 | 70 | 95 | 92 | 90 | 92 |

It should be noted that formulae 4, 5, 6 and 7 maintain their chlorine content very well.

Finally, the action on aluminum utensils is studied by washing two new aluminum saucepans with each of the detergents.

Washing is repeated until a distinct blackening effect is recorded relative to a new, reference saucepan.

The table which follows sets out the results of these tests.

| TESTS | 1 | 2 | 3 | 4 | 5 | 6 | 7 |
|---|---|---|---|---|---|---|---|
| Number of washes before blackening takes place | 2 | 20 | 8 | 6 | 25 | 26 | 25 |

It will be seen that blackening takes place immediately in the absence of an inhibitor (test 1), that the silico-aluminate alone has a slight tarnishing-inhibiting effect, that powdered sodium silicate gives results far inferior to those obtained with a silicate of the same molar ratio in liquid form, and above all that the composition containing both a silico-aluminate and a sodium silicate gives a novel, unexpected anti-tarnishing action.

I claim:

1. A non-corrosive detergent cleaning composition consisting essentially of by weight:

20 to 70% of sodium metasilicate 20 to 50% of sodium tripolyphosphate 0 to 40% of sodium carbonate 0 to 20% of sodium sulphate 0 to 10% of sodium borate 1 to 4% of sodium silico-aluminate 1 to 4% of a 30% liquid sodium silicate, with a molar ratio $SiO_2/Na_2O_3$ of from 2.5 to 4/1

0.5 to 3% of a surfactant selected from the group consisting of condensates of ethylene oxide on propylene-glycol and ethylene oxide on alkyl-glycol, sodium alkylaryl-sulphonates, sodium alkylsulphates and sodium alkylsulphonates and mixtures thereof 0.5 to 3% of a compound which liberates chlorine, in which the sodium silico-aluminate and the liquid sodium silicate are incorporated as a premix with the liquid sodium silicate absorbed on the sodium silico-aluminate, and in which the sodium silico-aluminate is of the general formula $x\ Na_2O$, $y\ Al_2O_3$, $z\ SiO_2$, $w\ H_2O$, in which $y$ is 1, $x$ is within the range of 0 to 2, $z$ is within the range of 4 to 16 and $w$ is within the range of 0.3 to 4.

2. A non-corrosive composition in the form of a free flowing powder, a component in the detergent composition which inhibits corrosion and tarnishing of aluminum in the presence of chlorine in the form of a premix consisting essentially of a liquid sodium slicate having a molar ratio of $SiO_2/Na_2O$ of 2.5 to 4/1 absorbed on a sodium silico-aluminate having the general formula $x\ Na_2O$, $y\ Al_2O_3$, $z\ SiO_2$, $w\ H_2O$, in which $y$ is 1, $x$ is within the range of 0 to 2, $z$ is within the range of 4 to 16 and $w$ is within the range of 0.3 to 4, and in which the components are present in the premix in the ratio of 1–4 parts by weight of a 30% liquid sodium silicate and 1–4 parts by weight sodium silico-aluminate.

3. A composition as claimed in claim 2 in which $z$ is a number within the range of 6 to 15.

4. A composition as claimed in claim 2 in which $w$ is a number within the range of 0.5 to 2.5.

5. A composition according to claim 2 in which the composition contains sodium dichloro-isocyanurate from which chlorine is derived.

6. A composition according to claim 2, in which the composition contains dihydrated sodium dichloroisocyanurate from which chlorine is derived.

7. A composition according to claim 2, characterized in that the sodium silico-aluminate is a synthetic, amorphous sodium silico-aluminate with a BET specific surface area from 50 to 600 $m^2$/gram, that agglomerates thereof have an average dimension from 2 to 10 $\mu$ while the ultimate particles have a dimension ranging from 50 to 900 A, and that the porosity of the aluminate, as measured with a mercury porosimeter for cavities in the range from 400 A to 2.5 $\mu$, is from 50 to 200 $cm^3$/100 grams.

8. A composition as claimed in claim 7 in which the BET specific surface area is within the range of 70 to 250 $m^2$/g.

* * * * *